US009506233B2

(12) United States Patent
Allard

(10) Patent No.: US 9,506,233 B2
(45) Date of Patent: Nov. 29, 2016

(54) STORMWATER TREATMENT SYSTEM WITH GUTTER PAN FLOW DIVERTER

(71) Applicant: KriStar Enterprises, Inc., Santa Rosa, CA (US)

(72) Inventor: Douglas Paul Allard, Santa Rosa, CA (US)

(73) Assignee: Oldcastle Precast, Inc., Atlanta, GA (US)

( * ) Notice: Subject to any disclaimer, the term of this patent is extended or adjusted under 35 U.S.C. 154(b) by 427 days.

(21) Appl. No.: 13/918,839

(22) Filed: Jun. 14, 2013

(65) Prior Publication Data

US 2014/0367328 A1 Dec. 18, 2014

(51) Int. Cl.

| | |
|---|---|
| ***C02F 3/32*** | (2006.01) |
| ***E03F 1/00*** | (2006.01) |
| ***E03F 5/04*** | (2006.01) |

(52) U.S. Cl.

CPC ..... *E03F 1/002* (2013.01); *E03F 5/0401* (2013.01); *Y10T 29/49826* (2015.01)

(58) Field of Classification Search

CPC ..... C02F 3/32; E03F 1/002; E03F 5/0401; Y10T 29/49826

USPC ..... 210/602, 163, 164, 165, 166, 170.03

See application file for complete search history.

(56) References Cited

U.S. PATENT DOCUMENTS

| | | | |
|---|---|---|---|
| 4,537,687 | A | 8/1985 | Piper |
| 4,682,907 | A | 7/1987 | Gaudin |
| 5,322,629 | A | 6/1994 | Stewart |
| 5,437,786 | A | 8/1995 | Horsley |
| 5,549,817 | A | 8/1996 | Horsley |
| 5,569,387 | A | 10/1996 | Bowne |
| 5,624,576 | A | 4/1997 | Lenhart |
| 5,702,593 | A | 12/1997 | Horsley |
| 5,707,527 | A | 1/1998 | Knutson |
| 5,728,305 | A | 3/1998 | Hawkinson |
| 5,744,048 | A | 4/1998 | Stetler |

(Continued)

FOREIGN PATENT DOCUMENTS

| | | |
|---|---|---|
| WO | WO2010118110 | 10/2010 |

OTHER PUBLICATIONS

Americast, "Standard Detail—4' Wide Precast Filterra Curb Inlet with Internal Bypass," DWG: STD_4_FTCB, dated Mar. 3, 2011.

(Continued)

*Primary Examiner* — Fred Prince

(57) ABSTRACT

The invention provides structures, methods, and assemblies for processing fluid entering a treatment area. The invention also provides methods, apparatuses, and additional structures that are useful for managing storm water flow and inhibiting the flow of pollutants, debris, and other contaminants into drainage systems. One or more flow diverter pans are installed at one or more inlets of a treatment area, such as a bioretention treatment area or a storm water retention and detention system. The apparatus comprises a structural framework that can include a pan placed adjacent to an inlet of the treatment area, and internal walls extending upward from the floor of the pan and at least partially framing a bypass opening adjacent to the floor. Inlet and outlet openings of the pan define a primary flow route for fluid passing through the pan and to the surface of the treatment area. Inlet and bypass openings of the pan comprise a secondary flow route for fluid passing through the tray.

45 Claims, 6 Drawing Sheets

(56) References Cited

U.S. PATENT DOCUMENTS

| | | | |
|---|---|---|---|
| 5,759,415 | A | 6/1998 | Adams |
| 5,788,848 | A | 8/1998 | Blanche |
| 5,855,775 | A | 1/1999 | Kerfoot |
| 5,985,157 | A | 11/1999 | Leckner |
| 6,027,639 | A | 2/2000 | Lenhart, Jr. |
| 6,132,603 | A | 10/2000 | Mokrzycki |
| 6,277,274 | B1 | 8/2001 | Coffman |
| 6,350,374 | B1 | 2/2002 | Stever |
| 6,383,373 | B1 | 5/2002 | Nakao et al. |
| 6,406,218 | B1 | 6/2002 | Olson |
| 6,511,595 | B2 | 1/2003 | Crompton |
| 6,531,059 | B1 | 3/2003 | Morris et al. |
| 6,569,321 | B2 | 5/2003 | Coffman |
| 6,641,720 | B1 | 11/2003 | Crompton |
| 6,649,048 | B2 | 11/2003 | de Ridder |
| 6,652,743 | B2 | 11/2003 | Wallace et al. |
| 6,783,683 | B2 | 8/2004 | Collings |
| 6,881,338 | B2 | 4/2005 | Austin et al. |
| 6,905,599 | B2 | 6/2005 | Allard |
| 6,991,114 | B2 | 1/2006 | Allen, II |
| 6,991,734 | B1 | 1/2006 | Smith et al. |
| 6,998,038 | B2 | 2/2006 | Howard |
| 7,022,243 | B2 | 4/2006 | Bryant |
| 7,080,480 | B2 | 7/2006 | Urban et al. |
| 7,083,721 | B2 | 8/2006 | McClure et al. |
| 7,101,476 | B2 | 9/2006 | Kim |
| 7,186,058 | B2 | 3/2007 | Schluter |
| 7,186,333 | B2 | 3/2007 | Kluge |
| 7,237,981 | B1 | 7/2007 | Vitarelli |
| 7,294,256 | B2 | 11/2007 | Happel et al. |
| 7,296,692 | B2 | 11/2007 | Allen, II |
| 7,297,266 | B2 | 11/2007 | Cobb |
| 7,425,261 | B2 | 9/2008 | Siviter |
| 7,425,262 | B1 | 9/2008 | Kent |
| 7,470,362 | B2 | 12/2008 | Kent |
| 7,510,649 | B1 | 3/2009 | Lavigne |
| 7,582,216 | B2 | 9/2009 | Arnott et al. |
| 7,625,485 | B2 | 12/2009 | Siviter |
| 7,638,065 | B2 | 12/2009 | Stever |
| 7,674,378 | B2 | 3/2010 | Kent |
| 7,686,956 | B1 | 3/2010 | Casebier |
| 7,776,217 | B2 | 8/2010 | Lucas |
| 7,833,412 | B2 | 11/2010 | Holtz |
| 7,967,979 | B2 | 6/2011 | Grewal et al. |
| 7,985,335 | B2 | 7/2011 | Allard |
| 8,012,346 | B2 | 9/2011 | Peters, Jr. et al. |
| 8,110,105 | B2 | 2/2012 | Allen, II |
| 8,113,740 | B2 | 2/2012 | Boulton et al. |
| 8,287,728 | B2 | 10/2012 | Kania et al. |
| 8,303,816 | B2 | 11/2012 | Kent et al. |
| 8,318,015 | B2 | 11/2012 | Allen, II et al. |
| 8,333,885 | B1 | 12/2012 | Iorio |
| 8,501,016 | B2 | 8/2013 | Lord et al. |
| 8,535,533 | B2 | 9/2013 | Allard |
| 8,555,586 | B2 | 10/2013 | Lowe et al. |
| 8,591,729 | B2 | 11/2013 | Alqanee |
| 8,622,647 | B2 | 1/2014 | Flood, Jr. et al. |
| 8,679,327 | B2 | 3/2014 | Mellott et al. |
| 8,795,518 | B2 | 8/2014 | Alsaffar |
| 2002/0057944 | A1 | 5/2002 | Adams et al. |
| 2004/0226869 | A1 | 11/2004 | McClure |
| 2006/0151387 | A1 | 7/2006 | Yost et al. |
| 2007/0068878 | A1 | 3/2007 | Stever |
| 2007/0199869 | A1 | 8/2007 | Al-Assfour |
| 2007/0262009 | A1 | 11/2007 | Fitzgerald |
| 2008/0121594 | A1 | 5/2008 | Dierkes |
| 2008/0217227 | A1 | 9/2008 | Pank |
| 2008/0217257 | A1 | 9/2008 | Pank |
| 2008/0251448 | A1 | 10/2008 | Kent |
| 2009/0050583 | A1 | 2/2009 | Arnott |
| 2009/0107899 | A1* | 4/2009 | Ringenbach ..... E03F 1/00 210/164 |
| 2009/0218299 | A1 | 9/2009 | Cote |
| 2009/0250405 | A1 | 10/2009 | Allard |
| 2010/0206790 | A1 | 8/2010 | Holtz |
| 2011/0147303 | A1 | 6/2011 | Allard |
| 2011/0186492 | A1 | 8/2011 | Holtz |
| 2012/0031854 | A1 | 2/2012 | Allard |
| 2012/0152827 | A1 | 6/2012 | Allard |
| 2013/0001158 | A1 | 1/2013 | Condon et al. |
| 2013/0056399 | A1 | 3/2013 | Downare |
| 2013/0092632 | A1 | 4/2013 | Allard |
| 2013/0105387 | A1 | 5/2013 | Antoinette et al. |
| 2013/0180903 | A1 | 7/2013 | Kowalsky |
| 2014/0001127 | A1 | 1/2014 | Hymel et al. |
| 2014/0124424 | A1 | 5/2014 | Chai et al. |
| 2014/0202954 | A1 | 7/2014 | Lassovsky |

OTHER PUBLICATIONS

Americast, "Standard Detail—6' Wide Precast Filterra Curb Inlet with Internal Bypass," DWG: STD_6_FTCB, dated Mar. 3, 2011.
Americast, "Standard Detail—8' Wide Precast Filterra Curb Inlet with Internal Bypass," DWG: STD_8_FTCB, dated Mar. 3, 2011.
Americast, "Standard Detail Gutter and Curb Opening Filterra Curb Inlet with Internal Bypass," DWG: DTL_FTCB_GCO, dated Apr. 4, 2011.
"Filterra Curb Inlet with Internal Bypass Design Guidelines California Region," Undated.
"Filterra Curb Inlet with Internal Bypass General Notes," Undated.
Filterra, "Sizing Table for 4' Wide Vault Filterra Curb Inlet with Internal Bypass," "Sizing Table for 6' Wide Vault Filterra Curb Inlet with Internal Bypass," "Sizing Table for 8' Wide Vault Filterra Curb Inlet with Internal Bypass," Undated.
Kristar Enterprises, Inc "TreePod Biofilter with Internal Bypass (End Inlet)," Drawing No. TPB-IB-0001, dated Mar. 13, 2009.
Kristar Enterprises, Inc., "TreePod Biofilter with Internal Bypass (Side Inlet)," Drawing No. TPB-IB-0002, dated Mar. 13, 2009.
Kristar Enterprises, Inc., "TreePod Biofilter with External Bypass (End Inlet)," Drawing No. TPB-XB-0001, dated Mar. 3, 2009.
Kristar Enterprises, Inc., "TreePod Biofilter with External Bypass (Side Inlet)," Drawing No. TPB-XB-0002, dated Mar. 3, 2009.
International Search Report and Written Opinion for International Application No. PCT/US 2014/042077, date of mailing Aug. 12, 2014 (11 pages).
Office Action for U.S. Appl. No. 13/214,230, notification date Apr. 15, 2014 (13 pages).
Office Action for U.S. Appl. No. 12/977,015, notification date May 22, 2014 (25 pages).
International Preliminary Report on Patentability for International Application No. PCT/US2014/042077, date of Issuance Dec. 15, 2015 (7 pages).
Notification Concerning Transmittal of International Preliminary Report on Patentability for International Application No. PCT/US2014/042077, date of mailing Dec. 23, 2015 (1 page).

* cited by examiner

STORMWATER TREATMENT SYSTEM WITH GUTTER PAN FLOW DIVERTER

FIELD OF THE INVENTION

The present invention relates to apparatuses and methods that are useful for treating or filtering storm water runoff, and more particularly to apparatuses and methods for use in conjunction with storm water treatment areas, such as bioretention treatment areas or storm water retention and detention assemblies, to manage storm water flow and inhibit the flow of pollutants, debris, and other contaminants into drainage systems.

BACKGROUND OF THE INVENTION

Many federal and state regulatory schemes require controlling storm water run-off and water quality, such as levels of pollutants on new developments of land. Before land development, an area will likely have included a variety of natural land features, such as sand dunes, grassy hills and wetlands. The natural land features absorb rainwater and infiltrate storm water runoff into the soil to replenish groundwater and streams. Following land development, however, the area might contain impervious surfaces such as buildings, streets, and parking lots that cover the ground and prevent rainfall infiltration. As a result, storm water runoff can accumulate pollutants such as oil and debris, which then flows into a sewer system or other receiving water bodies.

A number of treatment systems are used in the art to manage storm water before it is released to a sewer system or other receiving system. Such systems include but are not limited to bioretention systems. Bioretention systems are a well-known Low Impact Design ("LID") approach to mitigate the impacts of impervious surfaces and manage the flow of storm water runoff on developed land. The systems utilize soils and both woody and herbaceous plants to remove pollutants, including ultra-fine and dissolved pollutants, from storm water runoff close to their source. The systems mimic the natural (i.e., pre-development) storm water flow from the land.

One type of bioretention system includes standard bioretention cells that employ inorganic and organic materials known in the art. Storm water is collected into a treatment area of the bioretention cell, through which the storm water is filtered as it percolates downward. Other types of bioretention systems include bioretention swales, also known as grassy swales, grassy drainage swales, vegetated swales, or simply "swales." Bioretention swales are a common and well known way of filtering, treating and/or draining storm runoff or other dirty water that falls on and/or passes over highways, roadways, parking lots and the like. Swales function as soil and vegetation-based filtration systems, removing pollutants through a variety of physical, biological, and chemical treatment processes. In a typical application, a bioretention swale includes a depression in the ground adjacent to a land improvement such as a highway, road, parking lot, subdivision or other similar development. The depression is substantially covered with a layer of grass that has become well rooted and established within the grassy swale. As passing fluid enters the grassy swale from a roadway or parking lot, for example, it is naturally filtered by the layers of the swale.

Another type of treatment system includes manufactured filters, such as a conventional tree box filter, which is also referred to as a tree box planter. Tree box filters are known in the art for controlling runoff from land. In a conventional tree box filter, storm water runoff flows into an in-ground or above ground vault-shaped container with bioretention media, including mulch, and engineered soil. As the tree box filter infiltrates and temporarily stores runoff water, the bioretention media captures particulate matter, including ultra-fine and dissolved pollutants, and allows the treated storm water to percolate through the system. The storm water eventually exists through an outlet in the container into a drainage system or water retention/storage system. Bioretention systems can also include rain gardens, storm water planters, and other types of bioretention cells that help to slow runoff and facilitate infiltration. Yet other examples of manufactured treatments systems can include storm water retention or detention systems or other storm water management systems that allow for storage, infiltration, treatment, filtration, rainwater harvesting, and/or other processing of storm water.

A concern that has emerged is the ability of treatment systems, including the above-described bioretention systems, to process large quantities of fluid during peak flow periods without having backups that result in localized flooding of the surrounding areas. Most treatment systems will have an upper limit for the amount of water that can be filtered at any time, as well as a maximum capacity for the amount of water that can be passed through the system in any event.

For example, a given bioretention swale can be specifically sized to handle the estimated amount of runoff from an adjacent land improvement for a given time period. At the end of that time period, the party responsible for the swale, such as a municipality, highway authority, developer or property owner, will typically conduct a reconstructive overhaul or replanting of the grass layer in the swale, as it is only a matter of time before pollutants and contaminants overrun the grass and topsoil layers of the swale. Frequently, such an overhaul or reconstruction may be needed ahead of schedule, due to the generally incessant flow of chemicals and pollutants from roadways and similar structures that are washed into swales and drainage systems by storms and other runoff events. Such overhauls or reconstructions are costly and time consuming, and additional problems may ensue in the event that they are delayed or needed ahead of schedule. A weak or failing swale may undesirably pass an inordinate amount of pollutants, sedimentation and other debris onward into a subsequent drainage system during the time that it takes to overhaul or replant the swale. In addition, as regulations tighten or various applications require a higher standard of filtration or pollutant removal, many typical swales and other current methods and systems for removing pollutants normally found in storm water runoff, including hydrocarbons, nitrates, and phosphates, may prove to be inadequate.

In addition, although a treatment system may offer removal of ultra-fine and dissolved and dissolved constituents, gross pollutants such as coarse sediment, trash, and debris can reduce system efficiency and increase maintenance needs. The entrance of gross pollutants, such as trash, debris, floatables, and coarse sediments, are known to "clog" the system and thus reduce the overall efficiency. It can also increase the maintenance frequency of typical treatment systems. Accumulation of gross pollutants can also result in backups and localized flooding of the surrounding areas. In some instances, treatment systems may be used with an underground drainage basin system to catch high storm water flows. The drainage basin systems can catch overflow and release the excess fluid flow into underground drain and piping systems. If introduced into the drainage basin system, trash and debris, may also accumulate and be released into the drain and piping systems, along with the overflow storm water.

Accordingly, there exists a need for treatment system that address many or all of the foregoing problems, including a system that can effectively process increased amounts of storm water runoff falling on or passing over highways, roadways, parking lots, and the like. To address storm water flow during periods of peak flow and increase the upper limit for fluid flow, one or more high-flow bypass mechanisms may be implemented needed.

It is also desirable to remove gross pollutants from incoming storm water prior to releasing it to an underground storm water management system. Ideally, a treatment system should pre-treat (e.g., using filtration) water flow from the developed land prior to releasing it. Pre-treatment apparatus that can remove at least some gross pollutants from the treated flows should be incorporated into the bioretention system in order to minimize land usage. The pretreatment apparatus also should be accessible for intermittent cleaning, repair, and/or other maintenance. Thus, it is another objective of the invention to provide a bioretention system that has pre-filtration capabilities to remove gross pollutants from storm water runoff before it is released. It is yet another objective of the invention to provide a flexible and economical design that simplifies the design of construction of storm water drainage systems in a landscape area.

BRIEF SUMMARY OF THE INVENTION

The present invention provides more effective methods and apparatuses for filtering and treating polluted or dirty water, such as storm water runoff, that passes over highways, roadways, parking lots, and the like. One particular advantage is the reduction in the workload required by treatment systems to remove the required amount of sedimentation, silt, and pollution over the course of their lifespans. The invention can include various modules installed in various configurations to receive and treat storm water. Another advantage of the present invention is its adaptability to different landscape features and treatment areas.

In one embodiment, the present invention is directed to an apparatus adapted to cooperatively engage with an inlet of a treatment area. The apparatus comprises a substantially rectangular pan comprising an inlet opening. The apparatus further comprises first compartment disposed within the pan and configured to receive fluid passing through the inlet opening, said first compartment comprising an outlet opening and a floor. The apparatus also comprises a second compartment disposed within the pan, downstream of said first compartment. The second compartment comprises a bypass opening. Fluid within the storage capacity of the first compartment is directed to the outlet opening of the first compartment. Fluid exceeding the storage capacity of the first compartment is directed away from the outlet opening and toward the bypass opening of the second compartment.

In another embodiment, the present invention is directed to an apparatus adapted to cooperatively engage with a treatment area, comprising: a substantially horizontal base member comprising an inlet opening, an outlet opening, a floor, and a bypass opening adjacent to the floor. The apparatus also comprises a frame member disposed above the base member, comprising: a perimeter rim and at least one internal wall extending substantially vertically through a plane of the base member. The internal wall is configured to direct at least a portion of fluid accumulating below the height of the internal wall toward the outlet opening of the base member. The internal is configured to direct at least a portion of fluid accumulating above the height of the internal wall away from the outlet opening and toward the bypass opening of the base member.

In yet another embodiment, the invention is directed to a system for processing storm water entering a treatment area. The system comprises substantially rectangular base structure removably coupled to the treatment area. The base structure comprises an inlet opening, an outlet opening, a floor, a bypass opening adjacent to the floor; and an internal wall disposed between the floor and the bypass opening, and adjoining opposite sides of the base structure. The base structure also comprises a substantially rectangular frame structure disposed above the base structure, and adapted to receive one or more grates. The inlet and outlet openings comprise a primary flow route for fluid passing through the system, and the inlet and bypass openings comprise a secondary flow route for fluid passing through the system. In a preferred embodiment, the primary flow route directs fluid toward the surface of the bioretention treatment area. The secondary flow route directs fluid away from the surface of the bioretention treatment area and toward a sub-drain. The invention can further comprise a pre-filter device interposed between the tray and the bioretention treatment area. In another embodiment, the bypass opening is disposed along a substantially center portion of the tray.

The present invention is also directed to methods of directing fluid toward a treatment area. An advantage of the present invention is the ability to install the inventive assembly at an inlet of a treatment area, with or without an intervening pre-filter device. The present invention may be used with or without high flow bypass features.

In the below description, numerous specific details are provided, such as the identification of various system components, to provide an understanding of embodiments of the invention. Numerous other variations and embodiments can be discerned from the above-detailed description of the intentions and illustrations thereof. One skilled in the art will recognize, however, that embodiments of the invention can be practiced without one or more of the specific details, or with other methods, components, materials, etc. In still other instances, well-known structures, materials, or operations are not shown or described in detail to avoid obscuring aspects of various embodiments of the invention. All such variations are encompassed within the scope and spirit of the present invention.

BRIEF DESCRIPTION OF THE DRAWINGS

Embodiments of the present invention may be described with reference to the accompanying drawings. The included drawings are for illustrative purposes and provide examples of possible structures for the disclosed inventive treatment systems with a flow diverter pan, which is also referred to as a gutter pan flower diverter. The drawings in no way limit any changes in form and detail that may be made to the invention by one skilled in the art without departing from the spirit and scope of the invention.

DETAILED DESCRIPTION OF THE INVENTION

Unless otherwise defined, all technical and scientific terms used herein have the same meaning as commonly understood by one of ordinary skill in the art to which this invention belongs. Although methods and similar or equivalent to those described herein can be used in the practice or testing of the present invention, suitable methods and materials are described herein. All publications, patent applications, patents, and other references mentioned herein are incorporated by reference in their entirety. In case of conflict, the present specification, including definitions, will control. In addition, the materials, methods, and examples are illustrative only and not intended to be limiting.

The present invention provides one or more components for a wide range of storm water management applications. These include but are not limited to include controlling and treating storm water flow in parking lot islands, median strips, and traffic islands, median strips, sidewalks, and swales. The treatment systems can be designed for installation in newly developed land or for retrofit in developed sites during resurfacing.

The present invention also provides an underground system for use in bioretention, storm water retention and/or detention, and other treatment systems. A wide range of underground water management applications may be addressed using the systems described herein. These include but are not limited to all bioretention applications typically addressed with tree boxes, planters, chambers, cisterns, etc. typically made using simple piping, pre-cast concrete type assemblies. Particular applications include underground storm water processing, rainwater harvesting, and other water run-off related issues.

Figure 1A:
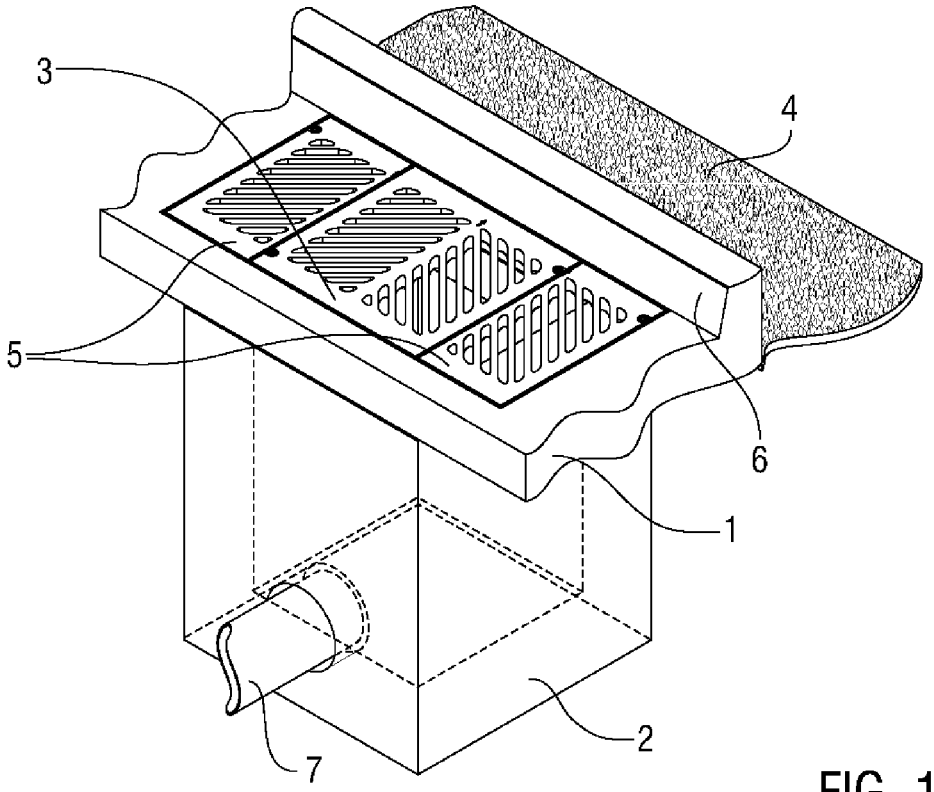
FIGS. 1A and 1B illustrate in angled top perspective view an example of a flow diverter pan with a catch basin, installed near a treatment area (viewed from the front and back, respectively).
Figure 1B:
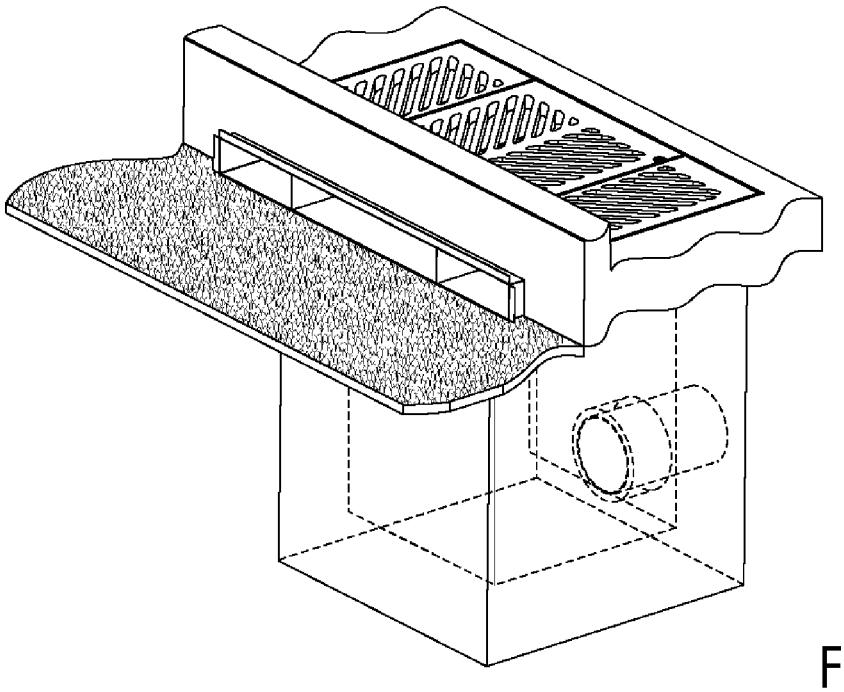

The flow diverter pans of the present invention provide the ability to accept water flow for filtration, retention and/or detention from a plurality of different sources and directions. Appropriate inlet opening(s) may be located along the pan around the exterior sides faces, a top side, or bottom side of the pan. In a preferred embodiment of the present invention, a flow diverter pan can be used to direct flows toward an adjacent storm water treatment area. Referring now to FIGS. 1A and 1B, an example of a flow diverter pan 1 can be coupled with a catch basin 2. In a typical application, the assembly can be positioned to facilitate the processing of storm water runoff or other fluid when such fluid enters a treatment area. This can be accomplished by installing a flow diverter pan with traffic rated frames or grating 3 (for high traffic areas) at one or more inlets of a treatment area 4, such that at least a portion of the any storm water runoff or other passing fluids is at least partially filtered, directed, or otherwise processed to some extent before entering the treatment area. In a preferred embodiment, one or more square traffic rated frames 3 may be used along a top portion, and different types of traffic rated frames 5 may be used along another top portion. The flow diverter pan can be placed near or under a curb 6.

The flow diverter pan may also be fabricated with a frame to accept industry standard grating. In the case of bioretention cell applications, flows from the pan may go directly to the surface of a treatment area or first be directed into a pre-filter device (as discussed below). The frames or grating help to prevent gross pollutants from entering the pan. The grating may be fabricated as a single piece, spanning the entire width of the device, or in multiple sections with varied style grates; i.e., vain style grating over one or more tray areas and standard high flow bar grating over one or more bypass areas.

An inlet of the flow diverter pan can be coupled to and preferably optimally oriented with respect to an inlet to the treatment area. As such, the inlet of the flow diverter pan effectively doubles as an inlet of the treatment area. In another embodiment, a flow diverter pan can direct fluid to the inlet of a manufactured filter system that is designed to pre-treat fluid before entering a treatment area. The ability to locate the assembly or assemblies in close proximity to (and to direct fluid to) a treatment area reduces the need for additional piping and pre-treatment devices, which reduces the costs and difficulties of piping and construction.

The storm water treatment area can include any of the treatment areas known in the art, including a grassy swale comprising a depression in the ground adjacent to a land improvement, tree box filters, other bioretention cells, storm water retention and detention systems. As passing fluid enters the treatment area from a roadway or parking lot, for example, at least some fluid encounters one or more inlets of the flow diverter pan for processing before the fluid passes through an outlet, toward the treatment area (or a pre-filtration system for the treatment area). During periods of peak storm water flow, at least a portion of the fluid entering the flow diverter pan is directed toward another outlet, and toward a bypass catch basin with an outlet pipe 7, drain or other storm drain piping system, instead of an adjacent treatment area. As will be discussed below, one or more structural elements connect an inlet of the flow diverter pan to an outlet of the system. Structural elements generally encompass walls, panels, walled grids, basin, or an overall frame and may include other elements. Other structural elements may be included as would be recognized by one of ordinary skill in the art.

Figure 2A:
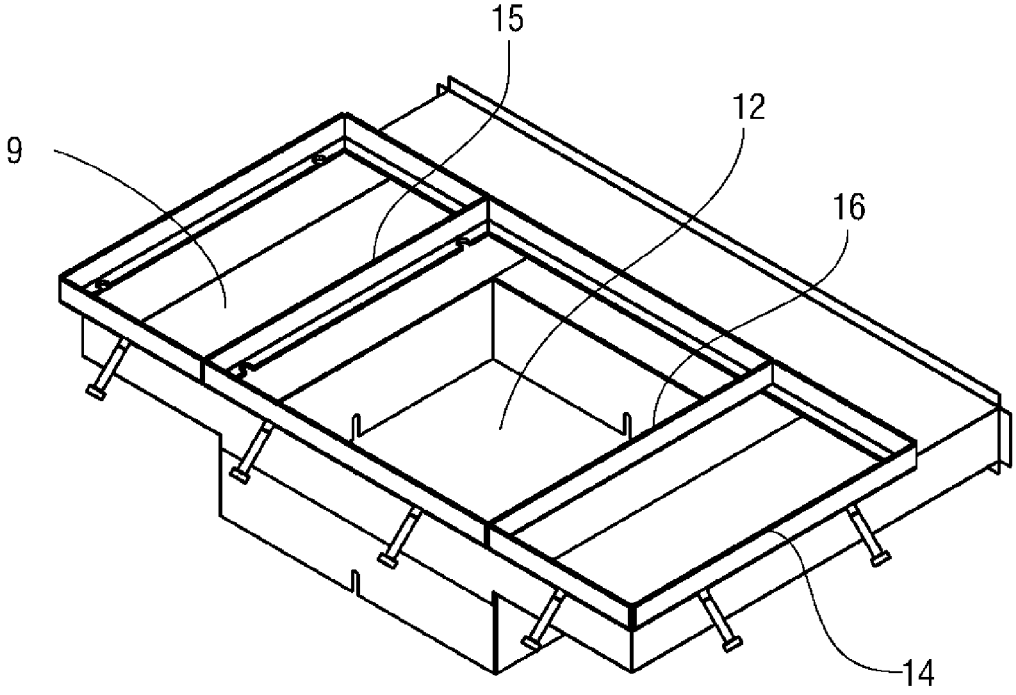
FIGS. 2A and 2B illustrate in angled top perspective view an example of a flow diverter pan with a catch basin, installed near a treatment area (viewed from the front and back, respectively).
Figure 2B:
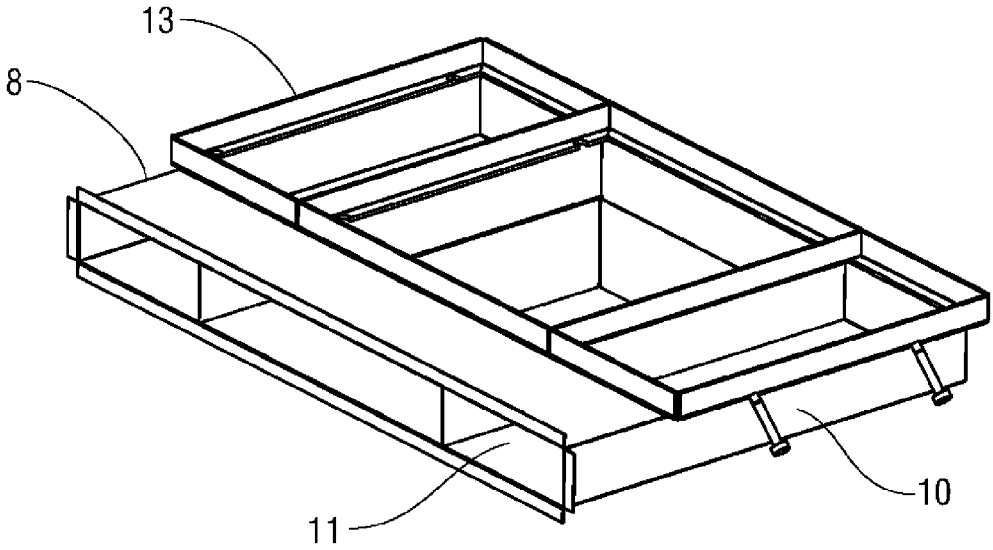

Referring to FIGS. 2A and 2B, an exemplary flow diverter pan according to one embodiment of the invention is illustrated in angled top view. In this embodiment, the flow diverter pan comprises a structural framework, including a substantially rectangular base member 8 with one or more bottom surfaces 9, side sections, and one or more inlet openings 10 along at least one side section. Storm water may also enter the pan via inlet openings (and corresponding grates) placed along a top side of the pan. The base member may also include one or more outlet openings 11 along another side section. In this embodiment, a bypass opening 12 is located in the center portion of the base member, although in practice, the inlet and bypass openings may be placed in different positions along the device, depending on the particular needs of the system. Although shown as substantially rectangular in shape, the base member may be designed in other shapes (i.e., circular, oval, curved edges, curved corners, and/or polygonal) to suit different landscape or excavation features.

The structural framework also comprises a substantially rectangular top member 13 coupled to (through the use of bolts, for example) and positioned above the base member. The top member can be an integral part of the base member and together with the base member, comprise a single, one-piece structure. Alternatively, the top and base members can be separate structures, stacked or coupled through one or more of the various connecting mechanisms known by those of ordinary skill in the art. A raised wall or frame 14 around its perimeter.

One or more internal weirs 15 and 16 surround an opening that aligns with the bypass opening of the base member. The weirs extend to the bottom of the base member to create channels for storm water flow along one or more tray areas (as well one or more side overflow openings), which are bounded on one side by exterior-facing sides of the weirs. The interior-facing sides of the weirs surround one or more bypass openings (shown in the center of the top member). It is contemplated that the weirs may be positioned closer toward the center to increase the size of the tray area and increase the volume of fluid that can be directed through the outlet. Alternatively, the weirs may be positioned further from the center of the device to decrease the size of the tray area(s) and increase the size of the bypass area(s). The weirs may contact an edge of the bypass opening, or they may be located along the floor of the assembly, a distance away from the bypass opening.

Figure 3:
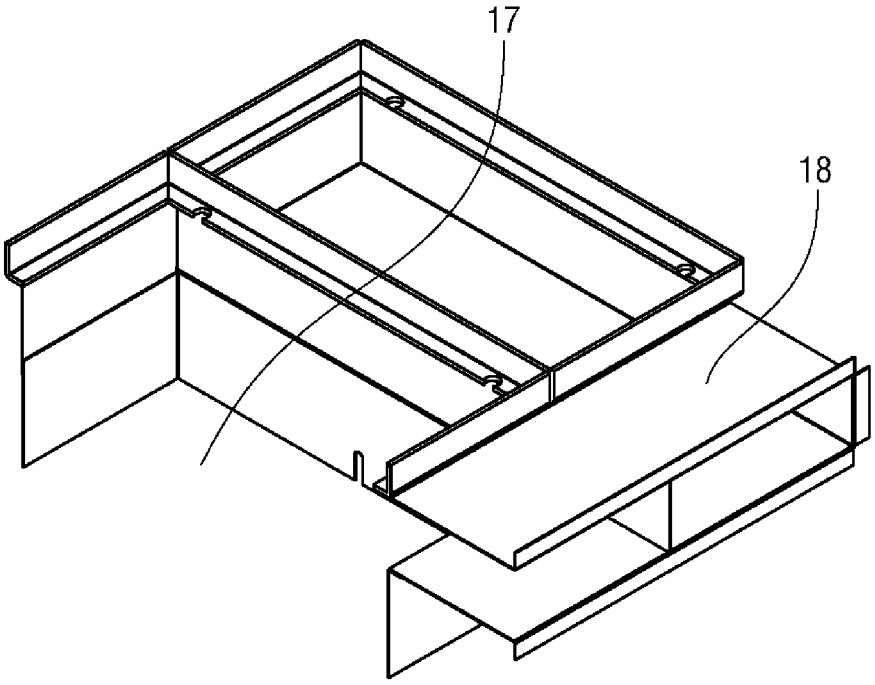
FIG. 3 is a side cross-sectional view of an example of a flow diverter pan with a high flow bypass feature.

As shown in cross-sectional view in FIG. 3, the bypass opening extends downward through the flow diverter pan and forms a bypass area within the device. The bypass opening 17 may be located in the center of the pan, as shown, to accept surface flows from two directions. For example, the flow diverter pan may be installed at low point or sump location and accept flows from opposite sides. Alternatively, the bypass opening may be offset to one side of the pan to accept flow from one direction (e.g., on slope).

In a preferred embodiment, the top member is shorter (in a lateral direction) than the base member, exposing a top surface 18 of the base member. The top surface can be designed to accommodate the width of a curb, such that the gutter pan flow diverter can be abutted up against a curb with the top surface positioned under at least a portion of the curb. The coupling of a flow diverter pan and a curb or other structure comprising a treatment area inlet can be achieved by any suitable coupling means, as would be readily understood by one skilled in the art. For example, one or more support posts may be case or otherwise inserted into a concrete or asphalt curb. Such support posts provide an anchor for attaching a structural framework of the flow diverter pan. The structural framework is preferably designed specifically to receive and be supported by these support posts in at least a lateral direction. In a preferred embodiment, each flow diverter pan is designed to have optimal dimensions for a particular size curb opening or treatment area inlet, to increase the effectiveness of the coupling of the inlet.

An advantage of the present invention is that the structural framework is an external structure that can be adapted to different treatment systems and retrofit, if needed. The structural framework can also cooperate with one or more pre-filter devices to process fluid before it enters a treatment area. As discussed, the flow diverter pan can also be used in connection with an optional catch basin with an outlet pipe. The optional catch basin can be designed to accept bypass flows from one or more bypass openings in the gutter pan flow diverter. In this embodiment, the base member includes a lower portion that is narrower than the frame section. The frame section is positioned above the catch basin, while the narrower portion of the base section fits within the walls of the catch basin. In a preferred embodiment, a lower part of the internal weirs form one or more sleeves that engage with the walls of a catch basin. The assembly may be attached to a catch basin walls at various locations along the weir so that the vertical position of the assembly may be selected and/or adjusted by the installer and/or designer.

Referring to FIGS. 2A and 2B, during periods of storm water flow, storm water enters at an inlet 10 of the base member (or through an inlet along a top portion of the assembly). The channels, which are formed by the weirs, along the tray areas provide a first passageway for incoming fluid. These channels retain "low flows" within the pan and direct the low flows toward outlet opening 11 and toward the surface of a treatment area. In a preferred embodiment, the outlet openings can be sized to obstruct the passage of gross pollutants such that at least some portion of the pollutants are retained in the pan and does not flow into the treatment area.

During periods of increased fluid flow or failure of the treatment areas to process fluids, storm water can accumulate in the pan. Should the high flow or failure condition worsen, the "high flows" may rise above the height of one or more of the weirs 15 and 16. High or bypass flows breach the top of the weir and enter the bypass opening 12 and pass through the side overflow openings, to the bypass area. One or more of the weirs can also restrict the passage of gross pollutants, thus restricting their flow through the bypass opening. The bypass opening can be optionally located directly over a bypass catch basin that is connected to a below ground storm drain piping system. At least a portion of the high flows is released from the pan without entering the treatment area.

Figure 4A:
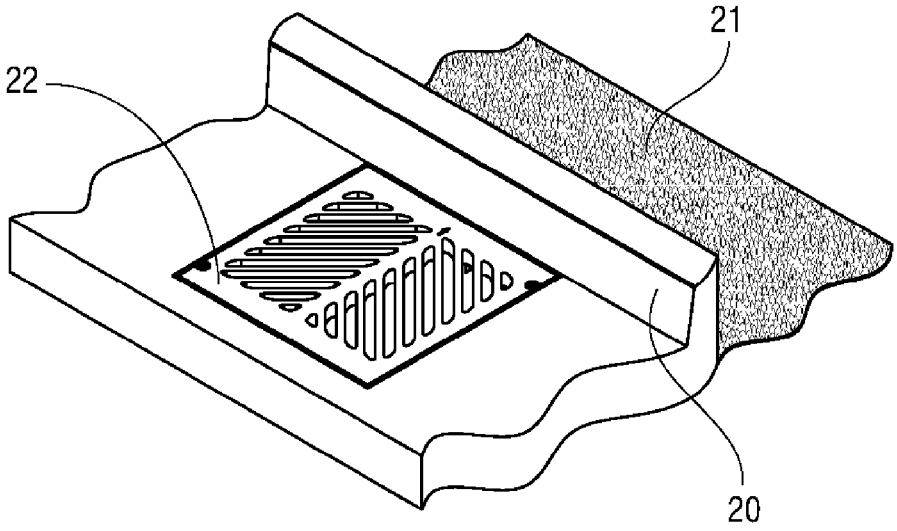
FIGS. 4A and 4B illustrate in angled top perspective view an example of a flow diverter pan without a high flow bypass feature, installed near a treatment area (viewed from the front and back, respectively).
Figure 4B:
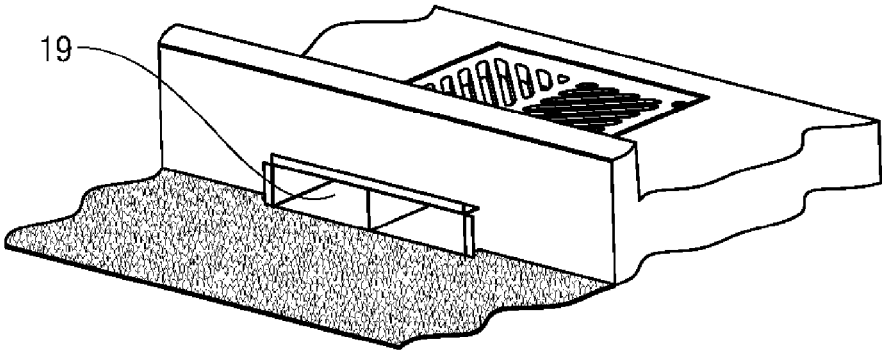
Figure 5A:
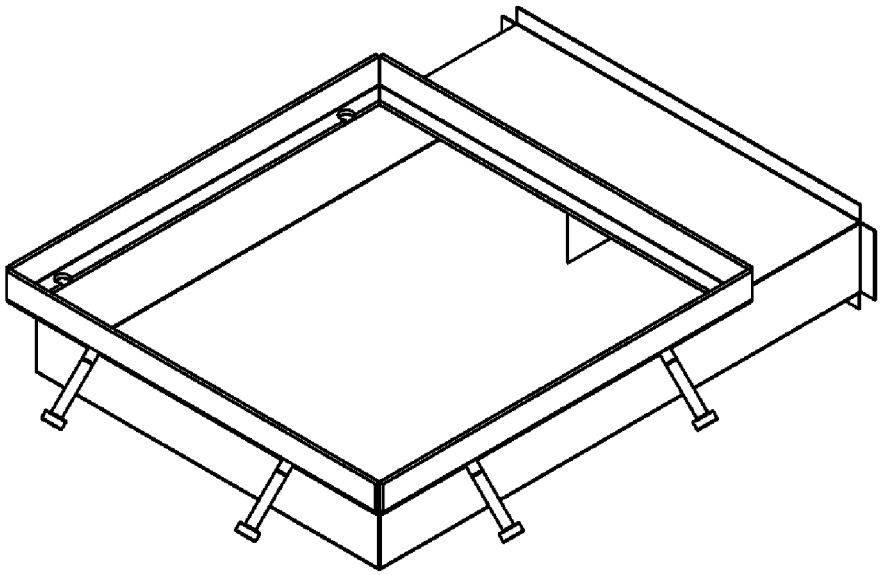
FIGS. 5A and 5B illustrate an angled top view of an example of a flow diverter pan without a high flow bypass feature, according to one embodiment of the present invention (viewed from the front and back, respectively).
Figure 5B:
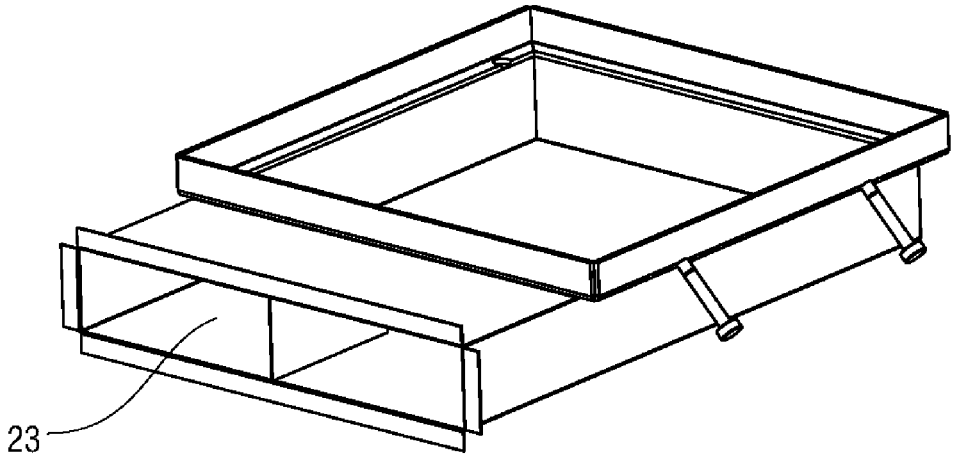

In another embodiment, the flow diverter pan can be alternatively fabricated without high flow bypass capability, such as that described above. In one embodiment, the top member of the device does not include internal weirs that form compartments within the device. Instead, the edges of the frame section form a single opening that receives fluid and directs it to a downstream treatment area. As shown in FIGS. 4A and 4B, a flow diverter pan 19 can be placed near or under a curb 20, next to a storm water treatment area 21. One or more traffic rated grates and frames 22 are positioned above the device. As shown in FIGS. 5A and B, fluid flows into the pan, after which it is directed through one or more outlet openings 23 to the surface of an adjacent treatment area.

Figure 6A:
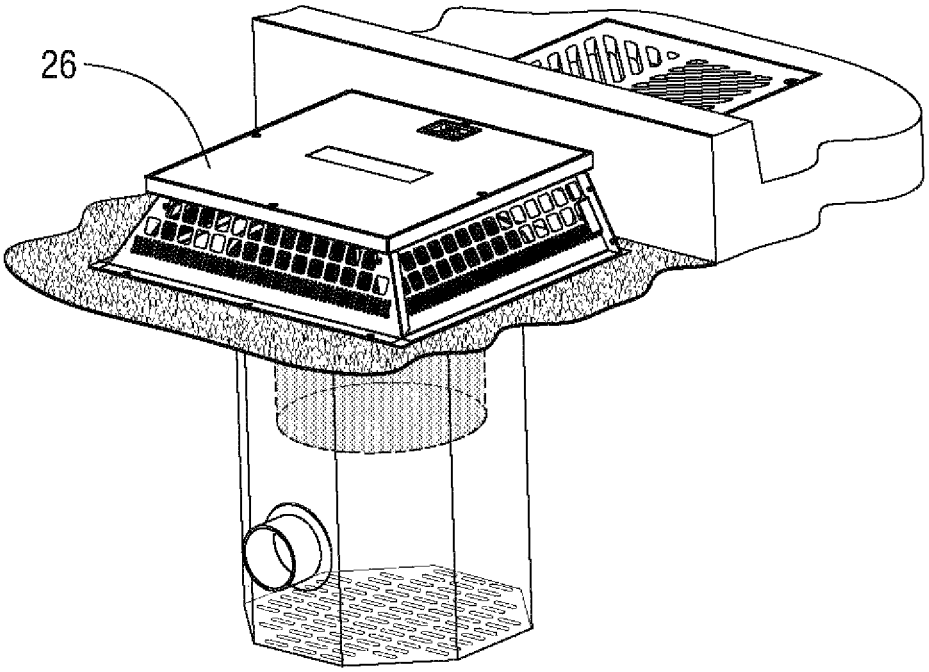
FIG. 6A illustrates an angled back view of an example of a flow diverter pan without a high flow bypass feature, installed with a grassy swale pre-filter device.
Figure 6B:
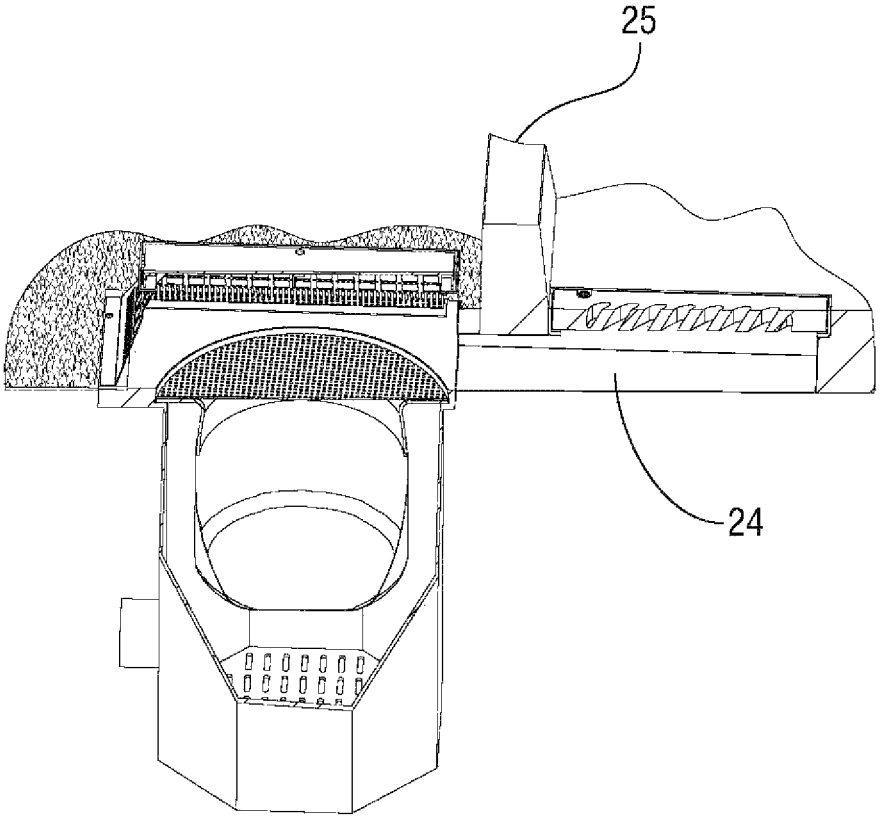
FIG. 6B illustrates a side cross-sectional view of the flow diverter pan shown in FIG. 6A.

In yet another embodiment, the flow diverter pan (with or without a high flow bypass) may be used in connection with a manufactured pre-filter device that is designed to pre-filter storm water before it enters a downstream treatment area. As an example, the flow diverter pan may be used in connection with the SwaleGard® Overflow Filter from KriStar Enterprises, Inc. or the grassy swale pre-filter device disclosed in U.S. Pat. No. 6,905,599 issued Jun. 14, 2005 to Douglas Allard, which is herein incorporated by reference. Referring to the embodiment shown in FIGS. 6 and 6B, the flow diverter pan 24 can be positioned along a curb 25, next to a pre-filtration device 26. Passing fluid flows onto the pan through one or more grates and frames. Sidewalls of the pan direct the storm water toward an inlet of the pre-filtration device, which is coupled to one or more grassy swale inlets.

The adaptable nature of the present invention provides a variety of design options and uses in different treatment systems. The gutter pan flow diverter can be used with additional filtration elements that allow treatment of fluids, as known by those of ordinary skill in the art. These include other types of walled basins, grid panels with regular spacings or slots, filter screens, filter baskets comprising one or more wall or floor elements that are permeable, filter linings, adsorbent containers, filtration materials, filtration media, and the like.

The flow diverter pan may be fabricated from various materials, including metal (steel, cast iron, stainless steel, fiberglass or HDPE plastic) or any other materials that can be molded or cast for water loading. It may be cast within a gutter, immediately adjacent to storm water treatment area, for the purpose of directing flows to either the surface of an industry standard bioretention cell, treatment cell, or into a manufactured filter system. As an added advantage, the flow diverter pan of the present invention may be removable to allow for periodic maintenance and/or access to the storm drain.

It is contemplated that the shapes and dimensions of the gutter pan flow diverter of the present invention, can vary within a range dependent on one or more design factors including but not limited to: overall system and site configuration, desired water flow capacity, desired weight of each unit, desired load-bearing tolerance, and/or the desired amount of water flow to be managed, size and structure of overall treatment area in which the assembly is used. The inlet and outlet openings of the present invention can also be positioned along the apparatus in different configurations and structural shapes, depending on the needs overall system configuration. For example, the inlet and/or outlet openings can be placed along a top portion of the apparatus. Multiple inlets as well as multiple outlets also may be employed. The relative location of the tray and bypass areas can also be changed to suit the structural needs of a particular landscape area.

The above disclosures are sufficient to enable one of ordinary skill in the art to practice the invention, and provide the best mode of practicing the invention presently contemplated by the inventor. While there is provided herein a full and complete disclosure of specific embodiments of this invention, it is not desired to limit the invention to the exact construction, dimensional relationships, and operation shown and described. Various modifications, alternative constructions, design options, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like.

What is claimed is:

1. An apparatus adapted to cooperatively engage with a treatment area, comprising:

(a) a base member comprising: an inlet opening, an outlet opening, a top surface, a floor, and a bypass opening adjacent to the floor; and (b) a frame member disposed above the base member, said frame member being shorter than the base member in a lateral direction to expose at least a portion of the top surface of the base member and comprising: a perimeter rim and at least one internal wall extending substantially downward to the floor of the base member;

wherein the internal wall is configured to direct at least a portion of fluid accumulating below the height of the internal wall toward the outlet opening of the base member; and further wherein the internal wall is configured to direct at least a portion of fluid accumulating above the height of the internal wall away from the outlet opening and toward the bypass opening of the base member.

2. The apparatus of claim 1, further comprising a treatment area adapted to receive fluid from the outlet opening of the base member.

3. The apparatus of claim 2, wherein the treatment area comprises at least one of the following: bioretention cell, grassy swale, and bioretention pre-filter device.

4. The apparatus of claim 2, wherein the treatment area comprises a storm water retention device.

5. The apparatus of claim 2, wherein the treatment area comprises a storm water detention device.

6. The apparatus of claim 2, wherein the treatment area comprises a pre-filter device.

7. The apparatus of claim 1, further comprising a catch basin coupled to the base member and adapted to receive fluid from the bypass opening.

8. The apparatus of claim 7, wherein the height of the internal wall is adjustable.

9. The apparatus of claim 1, wherein the apparatus is removably coupled to a treatment area.

10. The apparatus of claim 1, wherein the internal wall is integral to the base member.

11. The apparatus of claim 1, wherein the frame member comprises a plurality of internal walls.

12. A system for processing storm water entering a treatment area comprising:

(a) a treatment area;

(b) a substantially rectangular base structure removably coupled to the treatment area, comprising: (i) an inlet opening, (ii) an outlet opening, (iii) a top surface, (iv) a floor, (v) a bypass opening adjacent to the floor, and (vi) an internal wall disposed between the floor and the bypass opening, and adjoining opposite sides of the base structure; and (c) a substantially rectangular frame structure disposed above the base structure, and adapted to receive one or more grates, said frame structure being shorter than the base structure in a lateral direction to expose at least a portion of the top surface of the base structure;

wherein the inlet and outlet openings comprise a primary flow route for fluid passing through the system; and further wherein the inlet and bypass openings comprise a secondary flow route for fluid passing through the system.

13. The system of claim 12, wherein the treatment area comprises a bioretention treatment area, and the primary flow route directs fluid toward a surface of the bioretention treatment area.

14. The system of claim 13, wherein the secondary flow route directs fluid away from the surface of the bioretention treatment area and toward a sub-drain.

15. The system of claim 12, wherein the treatment area comprises a storm water retention device.

16. The system of claim 12, wherein the treatment area comprises a storm water detention device.

17. The system of claim 12, further comprising a pre-filter device interposed between the base structure and the treatment area.

18. The system of claim 12, further comprising a catch basin coupled to the base structure and adapted to receive fluid from the bypass opening.

19. The system of claim 18, wherein the height of the internal wall is adjustable.

20. The system of claim 12, wherein the bypass opening is disposed along a substantially center portion of the base structure.

21. The system of claim 12, comprising a plurality of internal walls.

22. A method of directing fluid toward the surface of a treatment area, comprising:

(a) selecting an inlet to a treatment area;

(b) installing an apparatus at the inlet of the treatment area, said apparatus comprising:

(i) a base member comprising: an inlet opening, an outlet opening, a top surface, a floor, and a bypass opening adjacent to the floor; and (ii) a frame member disposed above the base member, said frame member being shorter than the base member in a lateral direction to expose at least a portion of the top surface of the base member and comprising: a perimeter rim and an internal wall extending substantially downward to the floor of the base member;

wherein the internal wall directs at least a portion of fluid accumulating below the height of the internal wall toward the outlet opening and toward the surface of the treatment area; and further wherein the internal wall directs at least a portion of fluid accumulating above the height of the internal wall away from the outlet opening and toward the bypass opening;

(c) coupling said apparatus to said treatment area; and (d) passing fluid through said apparatus.

23. The method of claim 22, wherein the treatment area comprises at least one of the following: bioretention cell, grassy swale, and bioretention pre-filter device.

24. The method of claim 22, wherein the treatment area comprises at least one of the following: storm water retention device and storm water detention device.

25. The method of claim 22, wherein the treatment area comprises a pre-filter device adapted to receive fluid from the outlet opening.

26. The method of claim 22, wherein the apparatus further comprises a catch basin coupled to the base member and adapted to receive fluid from the bypass opening.

27. The method of claim 26, wherein the height of the internal wall is adjustable.

28. The method of claim 22, wherein the step of (c) coupling said apparatus to said treatment area comprises removably coupling said apparatus to said treatment area.

29. The apparatus of claim 22, wherein the internal wall is integral to the base member.

30. The method of claim 22, wherein the frame member comprises a plurality of internal walls.

31. A method of directing fluid toward a treatment area, comprising:

(a) selecting an inlet to a treatment area;

(b) installing a substantially rectangular apparatus at the inlet of the treatment area, said apparatus comprising: (i) an inlet opening, (ii) an outlet opening, (iii) a floor, (iv) a bypass opening adjacent to the floor, (v) an internal wall disposed between the bypass opening and the floor, and adjoining opposite sides of the apparatus; and (vi) a frame adapted to receive one or more grates;

wherein the frame is adapted to fit against a curb and gutter; wherein the inlet and outlet openings comprise a primary flow route for fluid passing through the apparatus; and further wherein the inlet and bypass openings comprise a secondary flow route for fluid passing through the apparatus; and (c) coupling said apparatus to said treatment area.

32. The method of claim 31, further comprising a pre-filter device interposed between the apparatus and the treatment area.

33. The method of claim 31, wherein the treatment area comprises at least one of the following: bioretention cell, grassy swale, and bioretention pre-filter device.

34. The method of claim 31, further comprising a downstream catch basin adapted to receive fluid from the bypass opening of the apparatus.

35. The method of claim 31, wherein the step of (c) coupling said apparatus to said treatment area comprises removably coupling the apparatus to the treatment area.

36. The method of claim 31, wherein the height of the internal wall is adjustable.

37. The method of claim 31, wherein the primary flow route directs storm water to the surface of the treatment area.

38. The method of claim 31, wherein the secondary flow route diverts storm water away from the treatment area and to a sub-drain.

39. An apparatus adapted to cooperatively engage with an inlet of a treatment area, comprising:

(a) a substantially rectangular pan comprising an inlet opening;

(b) a first compartment disposed within the pan and configured to receive fluid passing through the inlet opening, said first compartment comprising a storage capacity, an outlet opening, and a floor; and (c) a second compartment disposed within the pan, downstream of said first compartment, said second compartment comprising a bypass opening; and (d) a substantially rectangular frame disposed along an upper portion of the pan, said frame being adapted to fit against a curb and gutter;

wherein fluid within the storage capacity of the first compartment is directed through the outlet opening of the first compartment; and further wherein fluid exceeding the storage capacity of the first compartment is directed away from the outlet opening and toward the bypass opening of the second compartment.

40. The apparatus of claim 39, wherein the outlet opening of the first compartment is configured to release fluid to the surface of a bioretention treatment area.

41. The apparatus of claim 40, wherein the bioretention treatment area comprises at least one of the following: bioretention cell, grassy swale, and bioretention pre-filter device.

42. The apparatus of claim 40, wherein the outlet opening of the first compartment is configured to release fluid to a pre-filter device.

43. The apparatus of claim 39, wherein the outlet opening is configured to release fluid to an underground storm water detention device.

44. The apparatus of claim 39, wherein the outlet opening is configured to release fluid to an underground storm water retention device.

45. The apparatus of claim 39, wherein the bypass opening of the second compartment is configured to release fluid to a walled basin.

* * * * *